US011326368B2

(12) United States Patent
Hill

(10) Patent No.: US 11,326,368 B2
(45) Date of Patent: May 10, 2022

(54) LEAD SCREW LATCH

(71) Applicant: Carrier Corporation, Palm Beach Gardens, FL (US)

(72) Inventor: Matthew S. Hill, Aumsville, OR (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 381 days.

(21) Appl. No.: 16/609,416

(22) PCT Filed: May 1, 2018

(86) PCT No.: PCT/US2018/030446
§ 371 (c)(1),
(2) Date: Oct. 29, 2019

(87) PCT Pub. No.: WO2018/204357
PCT Pub. Date: Nov. 8, 2018

(65) Prior Publication Data

US 2020/0181941 A1 Jun. 11, 2020

Related U.S. Application Data

(60) Provisional application No. 62/500,013, filed on May 2, 2017.

(51) Int. Cl.
*E05B 19/00* (2006.01)
*E05B 47/00* (2006.01)

(52) U.S. Cl.
CPC ..... *E05B 19/0005* (2013.01); *E05B 47/0012* (2013.01); *E05Y 2201/434* (2013.01); *E05Y 2900/602* (2013.01)

(58) Field of Classification Search
CPC ..... E05B 19/0005; E05B 47/0012; E05B 2047/002; E05B 2047/0017;
(Continued)

(56) References Cited

U.S. PATENT DOCUMENTS 3,979,932 A * 9/1976 Piche ..... E05B 19/0005 70/63
4,609,780 A * 9/1986 Clark ..... G07C 9/00722 379/102.06
(Continued)

FOREIGN PATENT DOCUMENTS

CN 102444335 A 5/2012
CN 102444336 A 5/2012
(Continued)

OTHER PUBLICATIONS

ISR/WO, dated Jul. 31, 2018, 13 pages total.

*Primary Examiner* — Lloyd A Gall
(74) *Attorney, Agent, or Firm* — Cantor Colburn LLP

(57) ABSTRACT

A lead screw latch mechanism is provided and includes a gate check rotatable to assume locked and unlocked positions, a housing defining lock and unlock grooves and a key container. The key container includes a boss and is biased away from the gate check and selectively movable toward the gate check through the housing with the gate check assuming the locked position whereby the boss, having been received in the lock groove, is prevented from exiting the lock groove and the unlocked position whereby the boss, having been received in the lock groove, is permitted to exit the lock groove. The lead screw latch mechanism further includes an elastic assembly which, with the boss exited from the lock groove, drives key container rotation toward a rotational position at which the boss is aligned with the unlock groove.

20 Claims, 3 Drawing Sheets

(58) Field of Classification Search
CPC ..... E05Y 2201/434; E05Y 2900/602; E05G 1/005; E05G 1/04; E05G 2700/02
USPC ..... 70/63, 278.7, 456 R, 459; 109/47, 109/50–52; 206/37.1–37.5, 38.1
See application file for complete search history.

(56) References Cited

U.S. PATENT DOCUMENTS 4,615,281 A * 10/1986 Gaston ..... E05B 19/0005 109/46
4,759,204 A 7/1988 Neyret
4,829,796 A 5/1989 Kim
4,850,466 A 7/1989 Rogakos et al.
5,090,222 A * 2/1992 Imran ..... E05B 19/0005 292/19
5,186,516 A 2/1993 Alexander et al.
5,245,652 A * 9/1993 Larson ..... G07C 9/21 379/102.06
5,732,580 A 3/1998 Garnault et al.
5,758,526 A 6/1998 Gorokhovsky
5,791,172 A * 8/1998 Deighton ..... E05B 19/0005 292/199
5,794,465 A * 8/1998 Hill ..... A45C 11/321 248/552
5,794,466 A * 8/1998 Hungerford ..... E05B 19/0005 109/53
5,887,468 A * 3/1999 Hasan ..... A45C 11/328 70/456 R
6,058,751 A 5/2000 Dimig et al.
6,557,911 B2 5/2003 Nelsen et al.
6,739,633 B2 5/2004 Holloway et al.
6,782,725 B2 8/2004 Linares
7,051,559 B1 * 5/2006 Hollis ..... A63H 3/005 109/47
7,192,066 B2 3/2007 Ilea et al.
8,826,708 B2 9/2014 Lopes
2004/0012468 A1 1/2004 Hyp
2009/0277231 A1 11/2009 Kim
2010/0223968 A1 9/2010 Krueger
2013/0283869 A1 10/2013 Yano et al.
2015/0308152 A1 10/2015 Kamin

FOREIGN PATENT DOCUMENTS

EP 0493736 A2 7/1992
EP 1304443 A2 4/2003
EP 1760242 A2 3/2007
WO 2013079321 A1 6/2013

* cited by examiner

LEAD SCREW LATCH

CROSS-REFERENCE TO RELATED APPLICATIONS

This application claims the benefit of PCT/US2018/030446 filed May 1, 2018, which claims priority to U.S. Provisional Application No. 62/500,013 filed May 2, 2017, which is incorporated herein by reference in its entirety.

BACKGROUND

The following description relates to a lock box component and, more particularly, to a lead screw latch for use with a lock box.

A real estate lock box is oftentimes a padlock-shaped box that hangs around the doorknob of a house that is on the real estate market. The device holds the keys to a house to allow communal access for all authorized real estate agents while continuing to keep the keys secure so that no one besides the authorized real estate as can enter the house. Permission to install a real estate lock box on the door is typically given by the seller or the owner of the home and permission to access the keys held by the real estate lock box is distributed by real estate services such as the multiple listing service (MLS).

In use, real estate lock boxes are normally secured with a manual key, a security code or a swipe card. In any case, an individual who has been granted access to the keys operates the real estate lock box by providing his/her access credential in whatever form is required and, if the credential is recognized and approved, the real estate lock box opens up so that the keys can be withdrawn.

BRIEF DESCRIPTION

According to one aspect of the disclosure, a lead screw latch mechanism is provided and includes a gate check rotatable to assume locked and unlocked positions, a housing defining lock and unlock grooves and a key container. The key container includes a boss and is biased away from the gate check and selectively movable toward the gate check through the housing with the gate check assuming the locked position whereby the boss, having been received in the lock groove, is prevented from exiting the lock groove and the unlocked position whereby the boss, having been received in the lock groove, is permitted to exit the lock groove. The lead screw latch mechanism further includes an elastic assembly which, with the boss exited from the lock groove, drives key container rotation toward a rotational position at which the boss is aligned with the unlock groove.

In accordance with additional or alternative embodiments, the gate check, the housing, the key container and the elastic assembly are housed in a lock box housing.

In accordance with additional or alternative embodiments, the lead screw latch mechanism further includes motor which is operable to rotate the gate check from the unlocked position to the locked position.

In accordance with additional or alternative embodiments, the gate check includes a body defining a central aperture and one or more offset holes and gear teeth disposed about at least a portion of a periphery of the body.

In accordance with additional or alternative embodiments, the housing includes an annular sidewall and a bulkhead supportively disposed on an interior face of the annular sidewall to define the lock and unlock grooves.

In accordance with additional or alternative embodiments, the boss includes radial bosses and the key container further comprises axial bosses.

In accordance with additional or alternative embodiments, the elastic assembly includes a helical driveshaft along which the key container is selectively movable, an elastic element interposed between key container components and a protrusion disposed on an interior one of the key container components.

According to another aspect of the disclosure, a lead screw latch mechanism is provided. The lead screw latch mechanism includes a gate check defining holes and being rotatable to assume locked and unlocked positions, a housing defining lock and unlock grooves and a key container. The key container includes first bosses receivable in the lock and unlock grooves and second bosses receivable in the holes. The key container is biased away from the gate check and selectively movable toward the gate check through the housing with the gate check assuming the locked position whereby the first bosses, having been received in the lock grooves, are prevented from exiting the lock grooves by an impingement of the second bosses against the gate check and the unlocked position whereby the first bosses, having been received in the lock grooves, are permitted to exit the lock grooves by the second bosses being received in the holes. The lead screw latch mechanism further includes an elastic assembly which, with the first bosses exited from the lock grooves, drives key container rotation toward a rotational position at which the first bosses are aligned with the unlock grooves.

In accordance with additional or alternative embodiments, the gate check, the housing, the key container and the elastic assembly are housed m a lock box, housing.

In accordance with additional or alternative embodiments, with the first bosses aligned with the unlock grooves, the key container is removable from the lock box.

In accordance with additional or alternative embodiments, the lead screw latch mechanism further includes a motor which is operable to rotate the gate check from the unlocked position to the locked position.

In accordance with additional or alternative embodiments, the gate check includes a body defining a central aperture and the holes such that the holes are offset from a rotational axis of the body and sear teeth disposed about at least a portion of a periphery of the body.

In accordance with additional or alternative embodiments, the housing includes an annular sidewall and a bulkhead supportively disposed on an interior face of the annular sidewall to define the lock and unlock grooves.

In accordance with additional or alternative embodiments, the first bosses include radial bosses and the second bosses comprise axial bosses.

In accordance with additional or alternative embodiments, the elastic assembly includes a helical driveshaft along which the key container is selectively movable, an elastic element interposed between key container components and a protrusion disposed on an interior one of the key container components.

According to yet another aspect of the disclosure, a lock box is provided. The lock box includes a lock box housing, a user interface device supportively disposed on the lock box housing and a lead screw latch mechanism disposed within the lock box housing. The lead screw latch mechanism includes a gate check, a housing, a key container, an elastic assembly and a motor. The motor is engaged upon a user inputting a recognized and approved credential via the user interface such that the gate check is rotated by the motor into an unlocked position and such that the key container is disposed to be completely pushed through the housing to thereby cause the key container to be placed in an ejectable position from the lock box housing by the elastic assembly.

In accordance with additional or alternative embodiments, the lock box housing includes a hook feature.

In accordance with additional or alternative embodiments, the gate check defines holes and is rotatable to assume a locked position and the unlocked position, the housing defines lock and unlock grooves, the key container includes first bosses receivable in the lock and unlock grooves and second bosses receivable in the holes, the key container is biased away from the gate check and selectively movable toward the gate check through the housing with the gate check assuming the locked position whereby the first bosses, having been received in the lock grooves, are prevented from exiting the lock grooves by an impingement of the second bosses against the gate check and the unlocked position whereby the first bosses, having been received in the lock grooves, are permitted to exit the lock grooves by the second bosses being received in the holes, and the elastic assembly which, with the first bosses exited from the lock grooves, drives key container rotation toward a rotational position at which the first bosses are aligned with the unlock grooves.

In accordance with additional or alternative embodiments, the gate check includes a body defining a central aperture and the holes such that the holes are offset from a rotational axis of the body and gear teeth disposed about at least a portion of a periphery of the body and the housing includes an annular sidewall and a bulkhead supportively disposed on an interior face of the annular sidewall to define the lock and unlock grooves.

In accordance with additional or alternative embodiments, the elastic assembly includes a helical driveshaft along which the key container is selectively movable, an elastic element interposed between key container components and a protrusion disposed on an interior one of the key container components.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

Because they typically protect valuable goods and property, real estate lock boxes are often subject to physical attacks. In addition, conventional real estate lock boxes often require high power and are bulky. Thus, as will be described below, a real estate lock box (hereinafter referred to as a "lock box") is provided that is not susceptible to known physical attacks, requires relatively little power to operate and can be made compact in size. To these ends, the lock box includes a latch mechanism m which a lead screw is used to load a torsion spring and a gate check that can be place in an authorized state to allow the latch mechanism to open.

Figure 1:
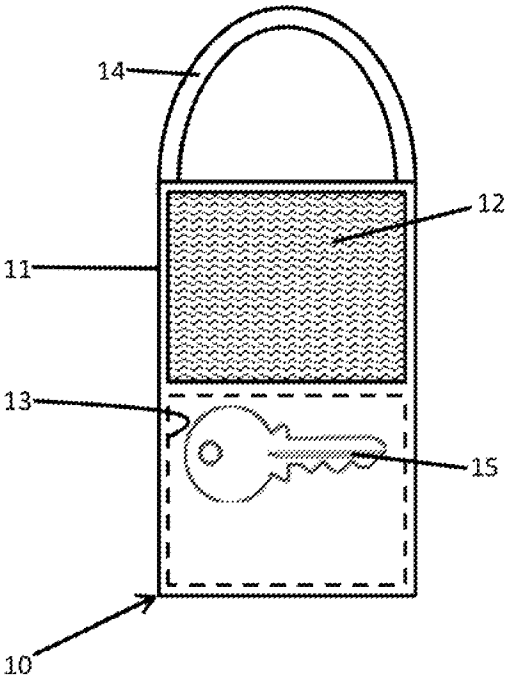
FIG. 1 is a schematic illustration of a lock box in accordance with embodiments.

With reference to FIG. 1, a lock box 10 is provided and includes a lock box housing 11, a user interface device 12 that is supportively disposed on the lock box housing 11 and a lead screw latch mechanism 13 that is disposed within the lock box housing 11. The lock box housing 11 may include a hook feature 14 that can be hooked onto a doorknob of a house and the lead screw latch mechanism 13 may include a key 15 that can be used by an authorized user to enter the house. In operation, the authorized user provides a credential to the user interface device 12 and, if the credential is recognized and approved, a motor of the lead screw latch mechanism 13 is engaged so that the lead screw latch mechanism 13 can be further operated by the authorized user as will be described below. As a result of such operation, a key container of the lead screw latch mechanism may be ejected from the lead screw latch mechanism 13 and the lock box housing 11 as a whole to reveal the key 15. At the point, the key 15 may be picked out of the key container by the authorized user and used to enter the house.

Figure 2:
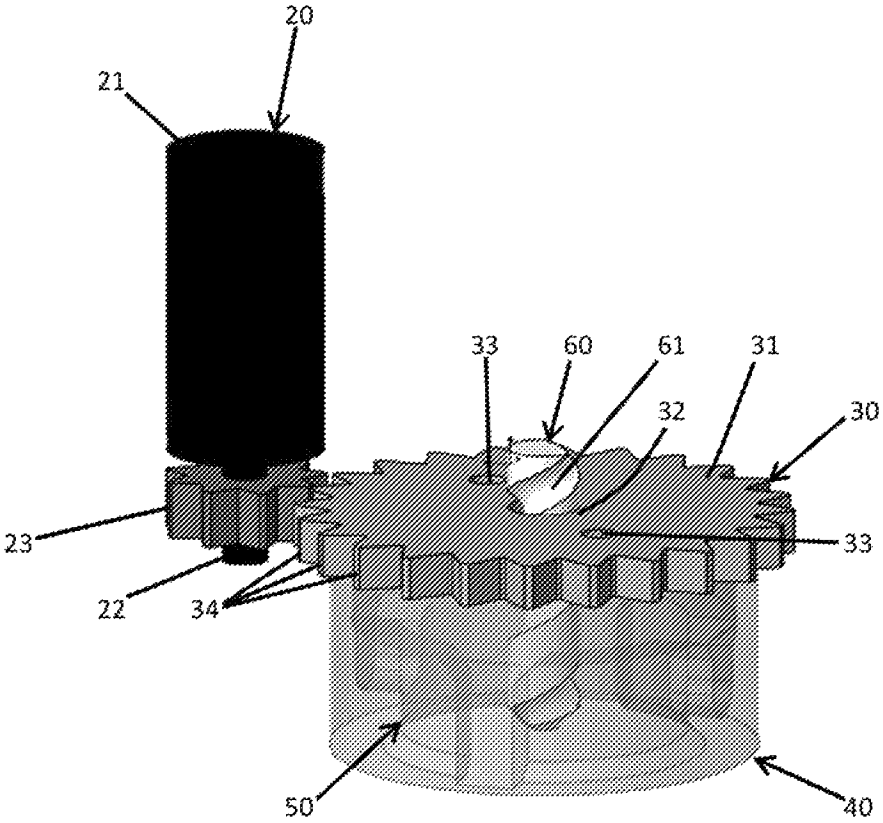
FIG. 2 is a perspective view of a lead screw latch mechanism of the lock box of FIG. 1 in accordance with embodiments.
Figure 4:
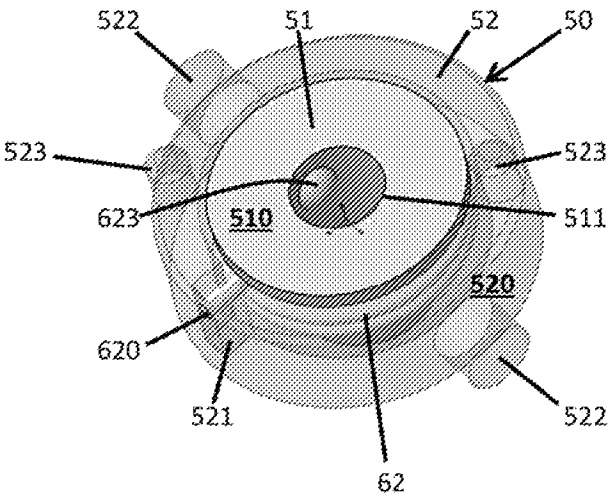
FIG. 4 is a perspective view of a key container and components of an elastic assembly of the lead screw latch mechanism of FIG. 2 in accordance with embodiments.
Figure 3:
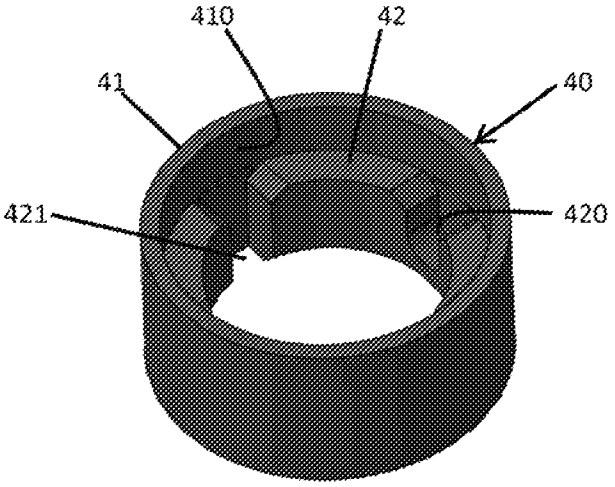
FIG. 3 is a perspective view of a lock housing of the lead screw latch mechanism of FIG. 2 in accordance with embodiments.

With reference to FIGS. 2, 3 and 4, the lead screw latch mechanism 13 includes a motor assembly 20, a gate check 30, a lock housing 40, a key container 50 and an elastic assembly 60.

The gate check 30 may be provided as a first gear element and includes a body 31 that is formed to define a central aperture 32 surrounding a central rotational axis of the gate check 30, gate holes 33 that are offset from the central rotational axis and gear teeth 34 disposed about all or at least a portion of the periphery of the body 31. The motor assembly 20 includes a motor 21, an output shaft 22 and a second year element 23 having gear teeth that are disposed to engage with the gear teeth 34 of the gate check 30. When the authorized user's credential is recognized and approved, the motor 21 is activated to generate rotational torque which rotates the output shaft 22 such that the output shaft 22, in turn, rotates the second gear element 23. The second gear element 23 thus causes the gate check 30 to rotate about the rotational axis.

At an initial time, the gate check 30 may be disposed to assume a locked rotational position and, upon the activation of the motor 21, may be disposed to assume an unlocked rotational position. Both the locked and unlocked rotational positions will be described in further detail below.

As shown in FIG. 3, the lock housing 40 includes an annular sidewall 41 that can be disposed such that a first longitudinal end thereof abuts or is proximate to a surface of the body 31 of the gate check 30. The lock housing 40 further includes a bulkhead 42 that is supportively disposed on an interior facing surface 410 of the annular sidewall 41. The bulkhead 42 is formed to define, a lock groove 420 and an unlock groove 421. The lock groove 420 has an open upper end and a closed bottom end. The unlock groove 421 has open upper and bottom ends. In accordance with embodiments, the bulkhead 42 may be formed to define two or more lock grooves 420 that are respectively opposite one another and two or more unlock grooves 421 that are respectively opposite one another.

As shown in FIG. 4, the key container 50 is disposable within the lock housing 40 and includes an interior container body 51 and an exterior container body 52. The interior container body 51 is provided as an annular body 510 that can carry a key therein with a central aperture 511. The exterior container body 52 is provided as an annular body 520 that can be disposed about the interior container body 51 such that relative rotation between the interior container body 51 and the exterior container body 52 is possible. The annular body 520 is formed to define a radial groove 521 and includes a first boss 522 and a second boss 523. The first boss 522 may be provided as multiple first bosses 522 that extend radially outwardly from an exterior sidewall of the annular body 520. The second boss 523 may be provided as multiple second bosses 523 that extend axially from an end wall of the annular body 520.

In accordance with embodiments, the following description will relate to the case where the body 31 of the gate check 30 is formed to define a pair of gate holes 33 that are oppositely offset from the central rotational axis, where the bulkhead 42 of the lock housing 40 is formed to define two opposite lock grooves 420 and two opposite unlock grooves 421 and where the annular body 520 correspondingly includes a pair of opposite first (or radial) bosses 522 and a pair of opposite second (or axial) bosses 523. This is being done for clarity and brevity and is not intended to limit the application as a whole or the claims in any way.

As shown in FIGS. 2 and 4, the elastic assembly 60 includes a helical drive shaft 61, a torsional spring 62 and a protrusion 623. The helical drive shaft 61 extends through the key container 50, the lock housing 40 and the central aperture 32 of the body 31 of the gate check 30. The torsional spring 62 is anchored to the interior container body 51 and includes a flange 620 that is disposable within the radial groove 521 of the annular body 520 of the exterior container body 52. The protrusion 623 protrudes from an interior facing surface of the central aperture 511 of the annular body 510 of the interior container body 51.

With continued reference to FIGS. 2-4 and with additional reference to FIGS. 5, 6 and 7, art operation of the lead screw latch mechanism 13 will now be described.

Figure 5:
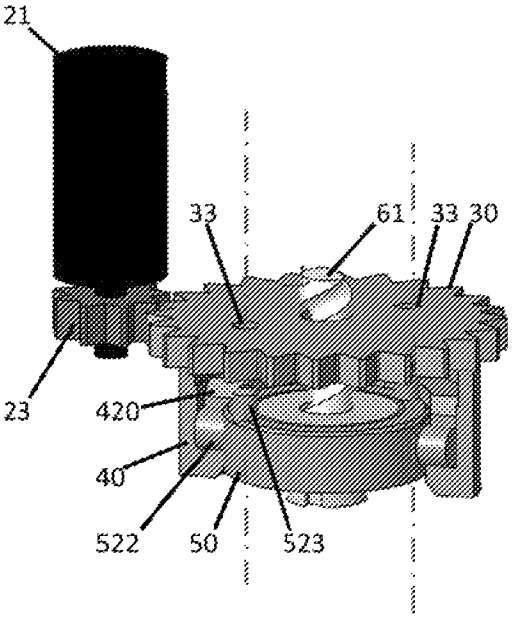
FIG. 5 is a perspective illustration of an early stage of an operational use of the lead screw latch mechanism of FIGS. 2-4.

As shown in FIG. 5, at an initial time, the gate check 30 may be disposed to assume the locked rotational position and the lock housing 40 may be disposed such that its first longitudinal end abuts or is proximate to the surface of the body 31 of the gate check 30. Here, the key container 50 is supportively disposed within the lock housing 40 such that the first bosses 522 sit against the closed bottom ends within the lock grooves 420 whereby the torsional spring 62 is not in tension and such that the second bosses 523 are misaligned with the gate holes 33. The key container 50 may be biased away from the gate check 30 by gravitational force or by an elastic element (not shown) which is anchored on the lock box housing 11 of the lock box 10. The helical drive shaft 61 extends through the key container 50, the lock housing 40 and the central aperture 32 of the body 31 of the gate check 30 such that the protrusion 623 engages with the helical grooves attic helical drive shaft 61.

With this initial configuration, the key container 50 can be pushed toward the gate check 30 in opposition to the bias applied thereto. Such pushing causes the protrusion 623 to ride along the helical grooves of the helical drive shaft 61 and thereby rotates the interior container body 51. The rotation begins to apply torsion to the torsional spring 62 through the interaction of the flange 620 and the radial groove 521. However, since the gate check 30 is disposed to assume the locked position whereby the second bosses 523 are misaligned with the gate holes 33, the second bosses 523 eventually impinge upon the body 31 of the gate check 30. This prevents complete movement of the key container 50 toward the gate check 30 and thus prevents the first bosses from clearing the lock grooves 420. Once the pushing of the key container 50 ceases, the key container 50 will return to its original position with the first bosses 522 seated against the closed bottom ends within the lock grooves 420 and the torsional spring 62 not being in tension.

Figure 7:
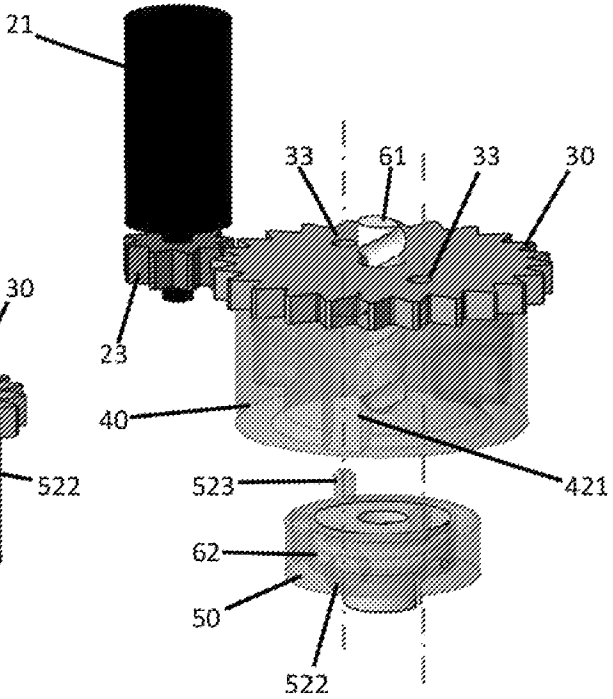
FIG. 7 is a perspective illustration of a late stage of an operational use of the lead screw latch mechanism of FIGS. 2-4.
Figure 6:
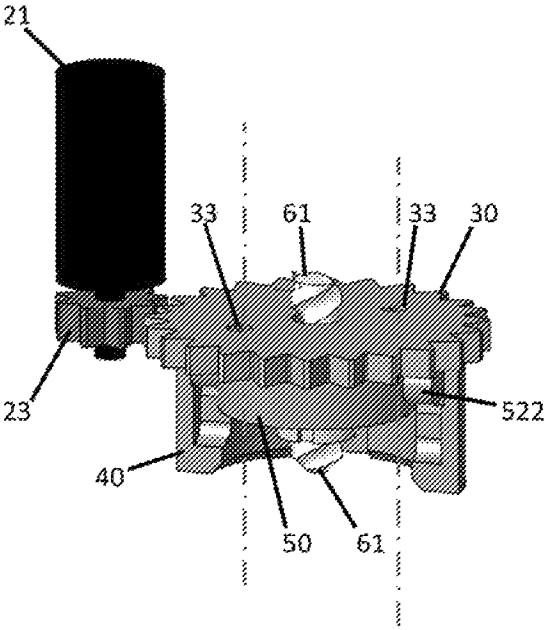
FIG. 6 is a perspective illustration of an intermediate stage of an operational use of the lead screw latch mechanism of FIGS. 2-4.

As shown in FIGS. 6 and 7, if the authorized user's credentials are recognized and approved, the motor 21 will be activated to rotate the gate check 30 such that the gate check assumes the unlocked rotational position at which the second bosses 523 are aligned with the gate holes 33. At this point, the key container 50 is pushed toward the gate check 30 in opposition to the bias applied thereto. Such pushing causes the protrusion 623 to ride along the helical grooves of the helical drive shaft 61 and thereby rotates the interior container body 51. The rotation once again begins to apply torsion to the torsional spring 62 through the interaction of the flange 620 and the radial groove 521. In this case, since the gate check 30 is disposed to assume the unlocked position whereby the second bosses 523 are aligned with the gate holes 33, the second bosses 523 are eventually received in and extend through the gate holes 33 and complete movement of the key container 50 toward the gate check 30 is permitted.

Upon the completion of the movement of the key container 50 toward the gate check 30, the first bosses 522 clear the lock grooves 420 and the torsional spring 62 is placed in a tension condition whereby the torsional spring 62 is permitted to rotate the exterior container body 52 relative to the interior container body 51. Such rotation brings the first bosses 522 into misalignment with the lock grooves 420 and into alignment with the unlock grooves 523. At this point, the pushing of the key container 50 toward the gate check 30 ceases and the bias of the key container 50 away from the gate check 30 drive the key container 50 along the helical drive shaft 61 whereby the tension in the torsional spring 62 is released and the key container 50 is permitted to fall out from the lead screw latch mechanism 13 and the lock box housing 11 of the lock box 10 as a whole. Here, the authorized user is able to remove the key 15 from the key container 50.

While the disclosure is provided in devil in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A lead screw latch mechanism, comprising:

a gate check rotatable to assume locked and unlocked positions;

a housing defining lock and unlock grooves;

a key container comprising a boss and being biased away from the gate check and selectively movable toward the gate check through the housing with the gate check assuming:

the locked position whereby the boss, having been received in the lock groove, is prevented from exiting the lock groove, and the unlocked position whereby the boss, having been received in the lock groove, is permitted to exit the lock groove; and an elastic assembly which, with the boss exited from the lock groove, drives key container rotation toward a rotational position at which the boss is aligned with the unlock groove.

2. The lead screw latch mechanism according to claim 1, wherein the gate check, the housing, the key container and the elastic assembly are housed in a lock box housing.

3. The lead screw latch mechanism according to claim 1, further comprising a motor which is operable to rotate the gate check from the unlocked position to the locked position.

4. The lead screw latch mechanism according to claim 1, wherein the gate check comprises:

a body defining a central aperture and one or more offset holes; and gear teeth disposed about at least a portion of a periphery of the body.

5. The lead screw latch mechanism according to claim 1, wherein the housing comprises:

an annular sidewall; and a bulkhead supportively disposed on an interior face of the annular sidewall to define the lock and unlock grooves.

6. The lead screw latch mechanism according to claim 1, wherein the boss comprises radial bosses and the key container further comprises axial bosses.

7. The lead screw latch mechanism according to claim 1, wherein the elastic assembly comprises:

a helical driveshaft along which the key container is selectively movable;

an elastic element interposed between key container components; and a protrusion disposed on at interior one of the key container components.

8. The lead screw latch mechanism according to claim 1, wherein the elastic assembly comprises:

a helical driveshaft along which the key container is selectively movable;

an elastic element interposed between key container components; and a protrusion disposed on an interior one of the key container components.

9. A lead screw latch mechanism, comprising:

a gate check defining holes and being rotatable to assume locked and unlocked positions;

a housing defining, lock and unlock grooves;

a key container comprising first bosses receivable in the lock acid unlock grooves and second bosses receivable in the holes, the key container being biased away from the gate check and selectively movable toward the gate check through the housing with the gate check assuming:

the locked position whereby the first bosses, having been received in the lock grooves, are prevented from exiting the lock grooves by an impingement of the second bosses against the gate check, and the unlocked position whereby the first bosses, having been received in the lock grooves, are permitted to exit the lock grooves by the second bosses being received in the holes; and an elastic assembly which, with the first bosses exited from the lock grooves, drives key container rotation toward a rotational position at which the first bosses are aligned with the unlock grooves.

10. The lead screw latch mechanism according to claim 9, wherein the gate check, the housing, the key container and the elastic assembly are housed in a lock box housing.

11. The lead screw latch mechanism according to claim 10, wherein, with the first bosses aligned with the unlock grooves, the key container is removable from the lock box housing.

12. The lead screw latch mechanism according to claim 9, further comprising a motor which is operable to rotate the gate check from the unlocked position to the locked position.

13. The lead screw latch mechanism according to claim 9, wherein the gate check comprises:

a body defining a central aperture and the holes such that the holes are offset from a rotational axis of the body; and gear teeth disposed about at least a portion of a periphery of the body.

14. The lead screw latch mechanism according to claim 9, wherein the housing comprises:

an annular sidewall; and a bulkhead supportively disposed on an interior face of the annular sidewall to define the lock and unlock grooves.

15. The lead screw latch mechanism according to claim 9, wherein the first bosses comprise radial bosses and the second bosses comprise axial bosses.

16. A lock box, comprising:

a lock box housing;

a user interface device supportively disposed on the lock box housing; and a lead screw latch mechanism disposed within the lock box housing and comprising a gate check, a housing, a key container, an elastic assembly and a motor, the motor being engaged upon a user inputting a recognized and approved credential via the user interface such that the gate check is rotated by the motor into an unlocked position and such that the key container is disposed to be completely pushed through the housing to thereby cause the key container to be placed in an electable position from the lock box housing by the elastic assembly.

17. The lock box according to claim 16, wherein the lock box housing comprises a hook feature.

18. The lock box according to claim 16, wherein:

the gate check defines holes and is rotatable to assume a locked position and the unlocked position, the housing defines lock and unlock grooves;

the key container comprises first bosses receivable in the lock and unlock grooves and second bosses receivable in the holes, the key container is biased away from the gate check and selectively movable toward the gate check through the housing with the gate check assuming:

the locked position whereby the first bosses, having been received in the lock grooves, are prevented from exiting the lock grooves by an impingement of the second bosses against the gate check, and the unlocked position whereby the first bosses, having been received in the lock grooves, are permitted to exit the lock grooves by the second bosses being received in the holes; and the elastic assembly which, with the first bosses exited from the lock grooves, drives key container rotation toward a rotational position at which the first bosses are aligned with the unlock grooves.

19. The lock box according to claim 18, wherein:

the gate check comprises a body defining a central aperture and the holes such that the holes are offset from a rotational axis of the body and gear teeth disposed about at least a portion of a periphery of the body, and the housing comprises an annular sidewall and a bulkhead supportively disposed on an interior face of the annular sidewall to define the lock and unlock grooves.

20. The lock box according to claim 16, wherein the elastic assembly comprises:

a helical driveshaft along which the key container is selectively movable;

an elastic element interposed between key container components; and a protrusion disposed on an interior one of the key container components.

* * * * *